United States Patent [19]

Nakamura et al.

[11] Patent Number: 5,069,277

[45] Date of Patent: Dec. 3, 1991

[54] VEHICLE-LOADED HEAT EXCHANGER OF PARALLEL FLOW TYPE

[75] Inventors: Miki Nakamura; Eiji Ohkura, both of Saitama, Japan

[73] Assignee: Diesel KiKi Co., Ltd., Tokyo, Japan

[21] Appl. No.: 492,456

[22] Filed: Mar. 13, 1990

[51] Int. Cl.[5] ..... F28F 9/04

[52] U.S. Cl. ..... 165/173; 165/153; 29/890.043

[58] Field of Search ..... 165/152, 153, 173; 29/890.043

[56] References Cited

U.S. PATENT DOCUMENTS

| | | | |
|---|---|---|---|
| 1,940,964 | 12/1933 | McIntyre | 165/153 X |
| 2,686,957 | 8/1954 | Koerper | 165/152 X |
| 3,064,707 | 11/1962 | Walts | 29/890.043 X |
| 4,693,307 | 9/1987 | Scarselletta | 165/152 |
| 4,722,387 | 2/1988 | Aurand | 165/153 |

*Primary Examiner*—Allen J. Flanigan

*Attorney, Agent, or Firm*—Kanesaka & Takeuchi

[57] ABSTRACT

An automotive heat exchanger of the parallel flow type includes a number of flat tubes (4), a number of corrugated fins (5), with the flat tubes and the corrugated fins being stacked alternately, the first cylindrical header tank (2) to which the tubes are connected by inserting one end thereof laterally into the first header tank, and the second cylindrical header tank (3) to which the tubes are connected by inserting the other end thereof laterally into the second header tank. The ends of each tube inserted laterally into the header tanks are cut off along the inner peripheral surfaces of the header tanks, thus minimizing the obstruction of flow in the headers. The header tanks may be made substantially elliptical.

11 Claims, 5 Drawing Sheets

VEHICLE-LOADED HEAT EXCHANGER OF PARALLEL FLOW TYPE

BACKGROUND OF THE INVENTION

1. Field of the Invention

This invention relates to a heat exchanger of the parallel flow type comprising a plurality of flat tubes and corrugated fins stacked alternately, a first header tank to which said tubes are connected by inserting one end thereof laterally into said first header tank and a second header tank to which said tubes are connected by inserting the other end thereof laterally into said second header tank.

2. Prior Art

Heat exchangers of the parallel flow type (e.g., vehicle-loaded condenser) conventionally comprise a plurality of flat tubes and corrugated fins stacked alternately, a first header tank to which said tubes are connected by inserting one end thereof laterally into said first header tank and a second header tank to which the tubes are connected by inserting the other end thereof laterally into said second header tank (each of said first and second header tanks usually comprises cylindrical pipe) so that parallel flows of refrigerant are established through a plurality of tubes between the first header tank and the second header tank.

Concerning the manner in which the respective tubes are connected to the respective header tanks, it is well known, as illustrated by FIG. 9, to form opposite ends of each tube 21 straight as viewed axially of the respective header tanks 22, then to insert this tube laterally into the respective header tanks 22 through respective insertion holes 23 with the straight formed ends extending beyond the edges of the insertion holes 23 by a predetermined extension to assure a sufficient brazing margin, and to braze these components together for integral connection therebetween (as disclosed, for example, by Japanese Patent Application Disclosure Gazettes Nos. 1986-235698 and 1988-112065). Such prior art employs the header tanks 22 each having a diameter larger than the width of each tube 21 so that the extent of the tube end extending into the respective header tanks 22 may be reduced and the refrigerant flow resistance occurring within the respective header tanks 22 may be alleviated.

However, such heat exchangers of the prior art inevitably encounters a problem that the use of large-diameter header tanks necessarily requires a correspondingly increased volume of refrigerant flowing therethrough although the refrigerant flow resistance can be certainly reduced by limiting the extent of the tube ends extending into the respective header tanks. It should be understood here that, so far as saving of refrigerant is concerned, small diameter header tanks are preferably employed in view of the fact that the volume of refrigerant normally occupying the header tanks corresponds substantially to 50% of that contained within the entire heat exchanger.

To solve this problem, it may be conceivable, as illustrated by FIGS. 10 and 11, to use small-diameter header tanks 24 to achieve the saving of refrigerant. However, such a countermeasure would necessarily result in a corresponding increase of the tube end extension into the respective header tanks 24 and, consequently, there would occur an undulant flow pattern of refrigerant around the tube ends, as indicated by a solid line arrow in FIG. 11, so the flow resistance and, therefore, the pressure loss would inconveniently increase.

This invention was made in view of the above-mentioned problem encountered by the conventional heat exchanger, to solve this problem in an effective manner.

SUMMARY OF THE INVENTION

Accordingly, a principal object of the invention is to provide a heat exchanger of the type described above so improved as to achieve both the saving of refrigerant within the header tanks and alleviation of the refrigerant flow resistance.

This object is achieved, according to the invention, by a heat exchanger of the parallel flow type comprising a plurality of flat tubes and corrugated fins stacked alternately, a first header tank to which the tubes are connected by inserting first ends thereof laterally into the first header tank and a second header tank to which the tubes are connected by inserting the other ends thereof laterally into the second header tank, characterized in that each end of each tube inserted laterally into each header tank is cut off along the inner peripheral surface of the header tank.

BRIEF DESCRIPTION OF THE DRAWINGS

These and other features, objects and advantages of the invention will be apparent from the following description of preferred embodiments thereof given in reference with the accompanying drawings, in which.

DETAILED DESCRIPTION OF THE PREFERRED EMBODIMENTS

Figure 1:
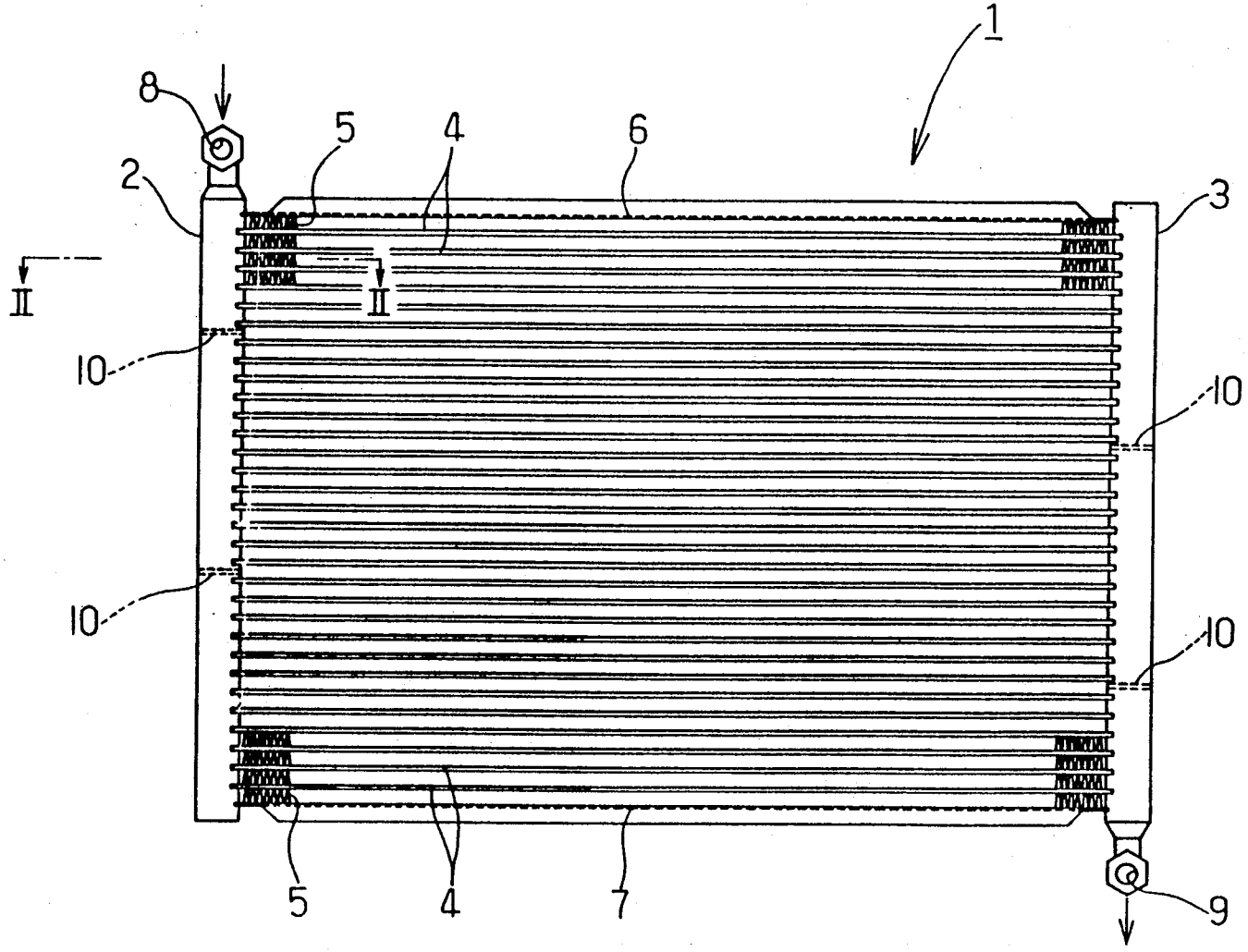
FIGS. 1 through 3 illustrate the first embodiment of the invention, FIG. 1 being a front view of the heat exchanger, FIG. 2 being a sectional view of the header tank taken along a line II—II in FIG. 1, and FIG. 3 being a sectional view taken along a line III—III in FIG. 2.
Figure 2:
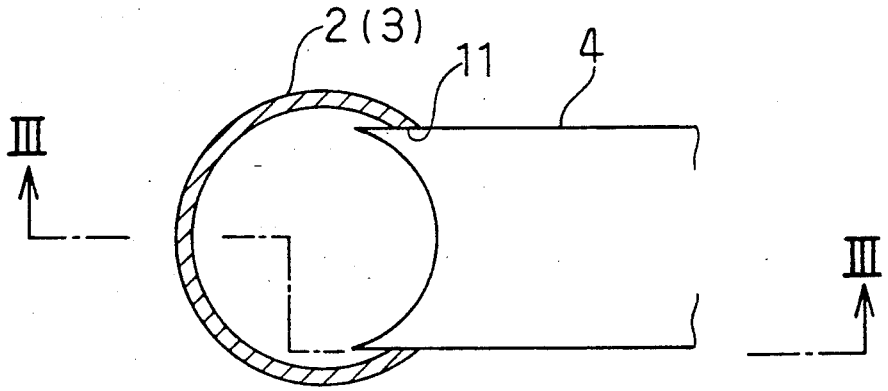

FIGS. 1 and 2 illustrate the first embodiment of the invention.

The heat exchanger (e.g., vehicle-loaded condenser) 1 of this embodiment comprises, as seen in FIG. 1, a plurality of flat tubes 4 arranged in parallel with one another and having their opposite ends connected to a first (e.g., inlet side) header tank 2 and to a second (e.g., outlet side) header tank 3, on the other side, and corrugated fins 5 interposed between respective pairs of adjacent flat tubes 4. The heat exchanger 1 further comprises side plates 6, 7. The first header tank 2 is provided with a joint 8 (e.g., inlet joint) and the second header tank 3 is provided with a joint 9 (e.g., outlet joint). Both the header tanks 2, 3 are provided with partition plates 10 so that a zigzag flow of refrigerant occurs between the joints 8, 9 associated with the header tanks 2, 3, respectively.

Figure 3:
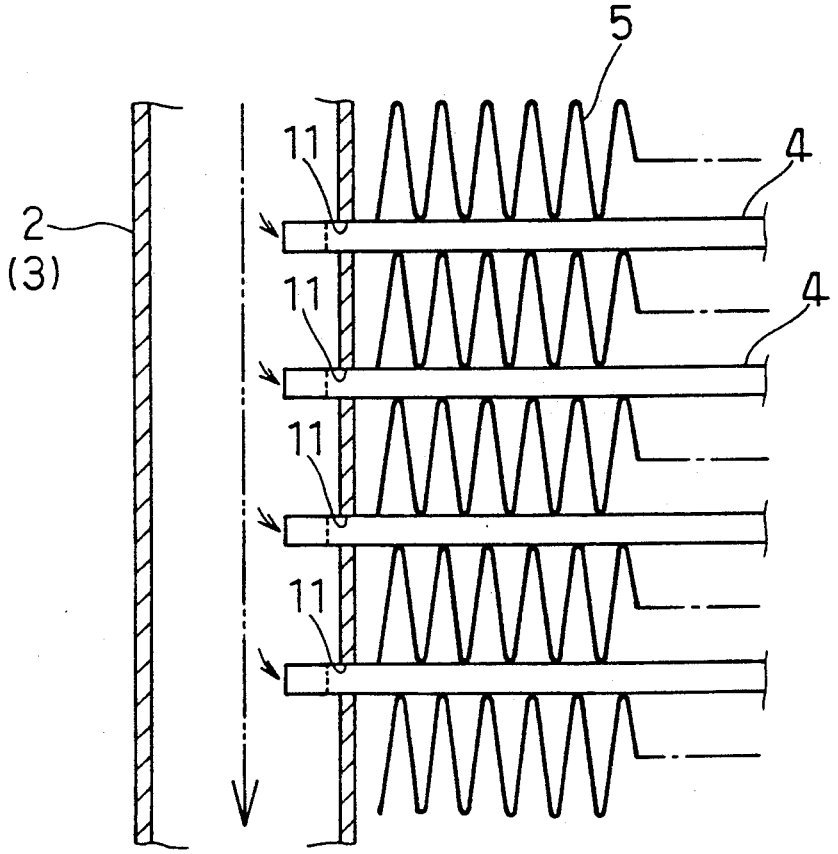

Each of the header tanks 2, 3 comprises, as seen in FIGS. 2 and 3, a pipe having a cylindrical cross-section and each of the tubes 4 has its opposite ends inserted laterally into the respective header tanks 2, 3 through associated insertion holes 11 by a predetermined extension to assure desired brazing margin. Then, the tube ends and the respective header tanks 2, 3 are brazed together for integral connection therebetween. Also as seen in FIGS. 2 and 3, the respective tube ends inserted laterally into the respective header tanks 2, 3 are, in accordance with this embodiment, cut off so as to be curved along the inner peripheral surfaces of the respective header tanks as viewed axially thereof, i.e., as viewed in the direction of refrigerant flow.

According to this embodiment, therefore, the extension of the tube ends extending into the respective header tanks 2, 3 is reduced, so the flow resistance of refrigerant flowing through the respective header tanks 2, 3 is significantly alleviated and the cross-sectional area of the refrigerant passage is enlarged. This allows correspondingly smaller-diameter header tanks to be used so as to reduce the volume of refrigerant within each header tank and to achieve the desired saving of refrigerant.

Now the second embodiment of the invention will be discussed.

Figure 4:
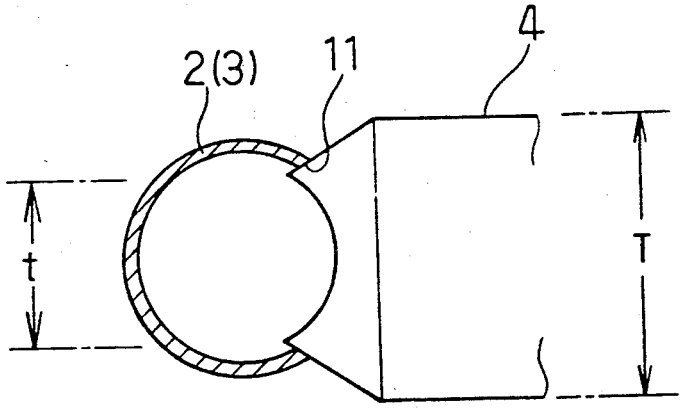
FIGS. 4 and 5 illustrate the second embodiment of the invention, FIG. 4 being a sectional view of the header tank and FIG. 5 being an end view of the tube.
Figure 5:
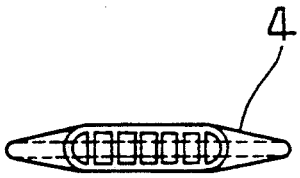
Figure 6:
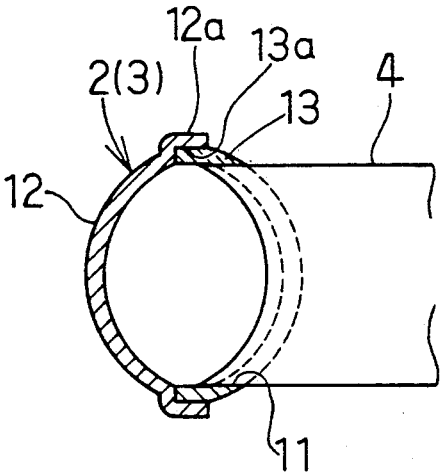
FIG. 6 is a sectional view of the header tank constructed as the third embodiment of the invention.

In accordance with this embodiment, as illustrated by FIG. 4, each of the tube ends has its width tapered toward the associated header tank and is cut off to present a curve similar to that in the previous embodiment. Additionally, each of the tapered tube ends is, as illustrated by FIG. 5, sufficiently thick to provide a refrigerant passage having a uniform cross-sectional area along its length.

Accordingly, the second embodiment allows, as illustrated by FIG. 4, the use of header tanks each having a diameter t smaller than the tube width T to be employed and further saving of refrigerant to be achieved.

Next, the third embodiment of the invention will be explained.

In this embodiment, each header tank 2, 3 is diametrically divided into a tank 12 and an end plate 13 while each of the tube ends is formed to present a curved shape similar to that in the previous embodiments.

According to this embodiment, the tank 12 and said end plate 13 are respectively circularly curved, substantially with the same radius of curvature, and joined together to present a substantially elliptical cross-section of the header tanks 2, 3. In this case, the end plate 13 is joined along its opposite joint edges 13*a* to the tank 12 with the joint edges 13*a* being placed inside corresponding joint edges 12*a* of the tank 12. The respective tubes 4 are inserted laterally into the header tanks through the insertion holes 11 of the end plate 13.

Accordingly, the third embodiment allows the header tank to be configured so as to present a substantially elliptical cross-section. This allows, in turn, the inner volume of each header tank to be reduced and thereby a further saving of refrigerant to be achieved.

Combination of the two-component header tank with the tapered tube end as shown by FIG. 4 will further improve the refrigerant saving effect.

Although the two-component header tank is illustrated as comprising the tank and the end plate both being curved with the substantially same radius of curvature, the tank and the end plate may be curved with different radii of curvature to form curved surfaces other than the circularly curved surfaces, for example, elliptically curved surfaces.

Figure 7:
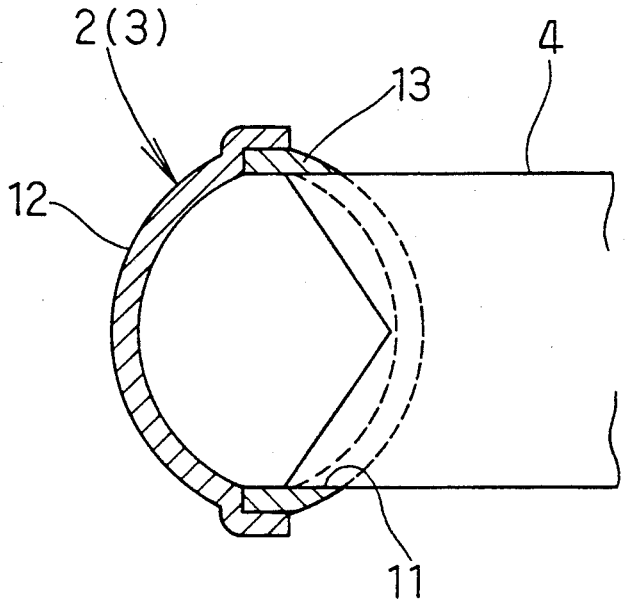
FIGS. 7 and 8 illustrate the fourth embodiment of the invention, FIG. 7 being a sectional view of the header tank and FIG. 8 being a view similar to FIG. 7 but illustrating a variance of the header tank illustrated by FIG. 7.
Figure 8:
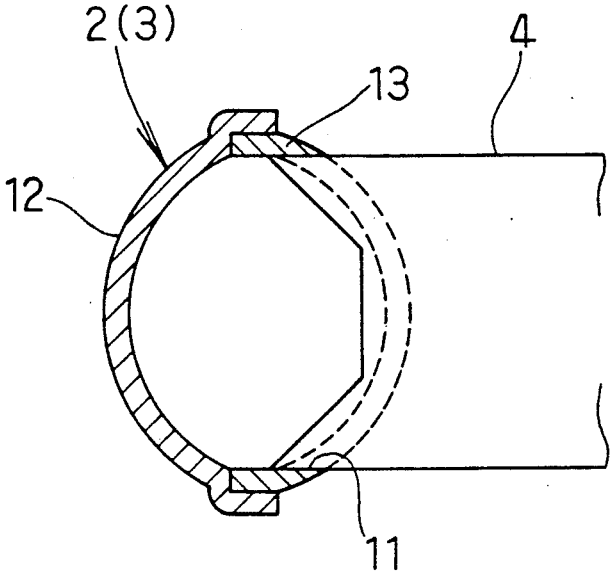
Figure 9:
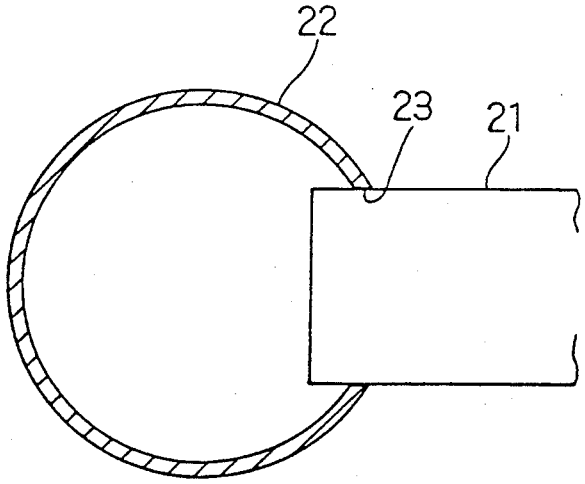
FIG. 9 PRIOR ART
FIGS. 9 through 11 illustrate the prior art, FIGS. 9 and 10 being sectional views of the header tanks, respectively, and FIG. 11 being a sectional view taken along a line XI—XI in FIG. 10.
Figure 10:
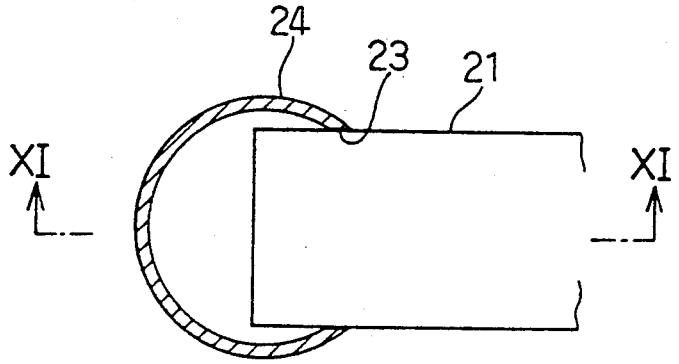
Figure 11:
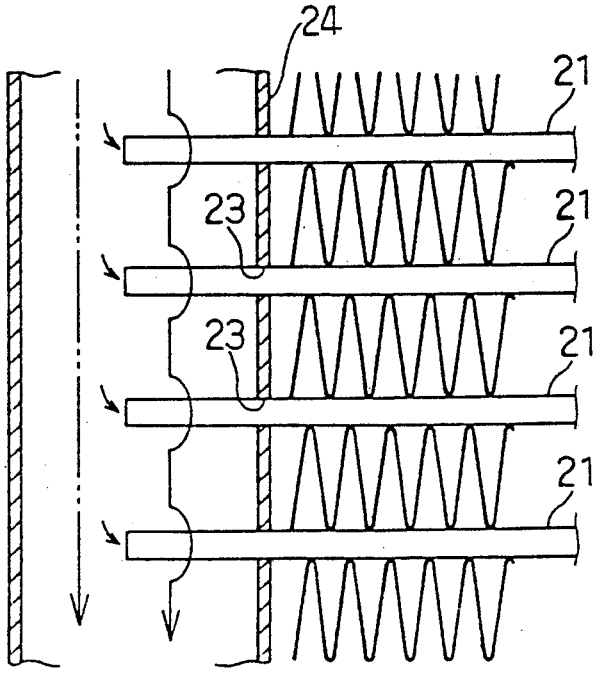

Finally, FIGS. 7 and 8 illustrate the fourth embodiment of the invention. This embodiment also employs the header tanks 2, 3, each diametrically divided into the tank 12 and the end plate 13 in the same manner as the third embodiment. Each end of the tube 4 may be triangularly shaped by cutting off from the initial tube end shape as illustrated by FIG. 7 or similarly may be trapezoidally shaped as illustrated by FIG. 8. Thus, in accordance with the invention, each end of each tube inserted into each header tank is cut off along the inner peripheral surface of the header tank, and therefore may have any shapes other than the circularly curved shape, for example, the angular shape as in this fourth embodiment.

What is claimed is:

1. A heat exchanger of the parallel flow type comprising a plurality of flat tubes and corrugated fins stacked alternatively, a first header tank to which said tubes are connected by inserting one end thereof laterally into said first header tank and a second header tank to which said tubes are connected by inserting the other end thereof laterally into said second header tank, characterized in that said header tanks have a substantially elliptical cross section and that each end of each tube inserted laterally into each header tank is cut off along an inner peripheral surface of the header tank with only a predetermined extension into said header tanks to not only assure a desired brazing margin but also reduce a flow resistance.

2. A heat exchanger of the parallel flow type comprising a plurality of flat tubes and corrugated fins stacked alternatively, a first header tank to which said tubes are connected by inserting one end thereof laterally into said first header tank and a second header tank to which said tubes are connected by inserting the other end thereof laterally into said second header tank, characterized in that each end of each tube inserted laterally into each header tank is cut off along an inner peripheral surface of the header tank and that each of the header tanks comprises a cylindrical pipe.

3. A heat exchanger of the parallel flow type as recited in claim 1, wherein each of the header tanks is diametrically divided into an end plate formed with tube insertion holes and a tank being remote from the tubes.

4. A heat exchanger of the parallel flow type as recited in claim 1, wherein said cut off tube end is circularly curved along the inner peripheral surface of the header tank.

5. A heat exchanger of parallel flow type as recited in claim 1, wherein said cut the off tube end is triangularly shaped with respect to an initial shape of the tube end.

6. A heat exchanger of the parallel flow type as recited in claim 1, wherein said cut off tube end is trapezoidally shaped with respect to an initial shape of the tube end.

7. A heat exchanger of the parallel flow type as recited in claim 1, wherein said header tanks have a diameter smaller than a width of a middle portion of said flat tubes which are tapered into said head tanks.

8. A heat exchanger of the parallel flow type as recited in claim 2, wherein said cut off tube ends are circularly curved along an inner peripheral surfaces of said header tanks.

9. A heat exchanger of the parallel flow type as recited in claim 2, wherein said cut off tube ends are triangularly shaped substantially along an inner peripheral surfaces of said header tanks.

10. A heat exchanger of the parallel flow type as recited in claim 2, wherein said cut off tube ends are trapezoidally shaped substantially along an inner peripheral surfaces of said header tanks.

11. A heat exchanger of the parallel flow type as recited in claim 2, wherein said header tanks have a diameter smaller than a width of a middle portion of said flat tubes which are tapered into said header tanks.

* * * * *